US011266880B2

(12) United States Patent
Hu

(10) Patent No.: US 11,266,880 B2
(45) Date of Patent: Mar. 8, 2022

(54) FOLDABLE SWIMMING GOGGLES

(71) Applicant: Dongguan RenTong Silicon Plastic Products Co., Ltd., Dongguan (CN)

(72) Inventor: Guoren Hu, Dongguan (CN)

( * ) Notice: Subject to any disclaimer, the term of this patent is extended or adjusted under 35 U.S.C. 154(b) by 216 days.

(21) Appl. No.: 16/705,244

(22) Filed: Dec. 6, 2019

(65) Prior Publication Data

US 2021/0170236 A1 Jun. 10, 2021

(51) Int. Cl.
*A63B 33/00* (2006.01)

(52) U.S. Cl.
CPC ..... *A63B 33/002* (2013.01); *A63B 33/004* (2020.08)

(58) Field of Classification Search
CPC ... A63B 33/002; A63B 33/004; A63B 33/006; A63B 33/008; A61F 9/02; A61F 9/025; A61F 9/027
USPC ..... 2/426, 454
See application file for complete search history.

(56) References Cited

U.S. PATENT DOCUMENTS 466,896 A * 1/1892 Warren ..... A61F 9/025 2/445
1,294,524 A * 2/1919 Newbold ..... G02C 5/045 2/445
1,363,689 A * 12/1920 Styll ..... G02C 5/06 351/126
1,432,406 A * 10/1922 Meyrowitz ..... A61F 9/025 2/445
1,760,650 A * 5/1930 Kruening ..... A61F 9/02 2/445
1,805,633 A * 5/1931 Moran ..... A61F 9/02 2/434
1,807,681 A * 6/1931 Baker ..... A61F 9/025 2/437
1,923,567 A * 8/1933 Baker ..... G02C 7/02 351/57
2,024,322 A * 12/1935 Wittig ..... G02C 7/088 359/411
2,130,127 A * 9/1938 Fischer ..... A61F 9/02 2/435
2,391,349 A * 12/1945 Ring ..... A61F 9/025 2/441
2,589,439 A * 3/1952 Seidel ..... A61F 9/025 2/441
2,603,785 A * 7/1952 Splaine ..... A61F 9/025 2/445
2,761,145 A * 9/1956 Malcom, Jr. ..... A61F 9/06 2/445

(Continued)

*Primary Examiner* — F Griffin Hall
(74) *Attorney, Agent, or Firm* — Prakash Nama; Global IP Services, PLLC

(57) ABSTRACT

Disclosed are foldable swimming goggles. The swimming goggles include a left frame body and a right frame body, wherein the left frame body is provided with a supporting block and a limiting block, the supporting block is internally provided with an accommodating groove, a pressing shaft is clamped in the accommodating groove, the lower portion of the pressing shaft is fixedly provided with a positioning rotary wheel, and the right frame body is provided with a steering block. Firm connection of the product is completed through the pressing shaft and the positioning rotary wheel. When the swimming goggles need to be folded, the pressing shaft is pressed to separate the positioning rotary wheel from the steering block, so that the right frame body rotates to make the product folded.

10 Claims, 6 Drawing Sheets

(56) References Cited

U.S. PATENT DOCUMENTS

| | | | | |
|---|---|---|---|---|
| 5,225,857 | A * | 7/1993 | Sakamoto | G02C 5/04 351/63 |
| 5,532,766 | A * | 7/1996 | Mateer | G02C 5/006 351/149 |
| 5,915,541 | A * | 6/1999 | Beltrani | A63B 33/002 2/430 |
| 7,581,513 | B2 * | 9/2009 | Di Lullo | A01K 13/006 119/850 |
| 8,833,933 | B1 * | 9/2014 | Huang | G02C 5/08 351/63 |
| 9,097,913 | B2 * | 8/2015 | Huang | G02C 5/006 |
| 10,561,902 | B2 * | 2/2020 | Saumureau | A63B 33/002 |

* cited by examiner

FOLDABLE SWIMMING GOGGLES

BACKGROUND OF THE INVENTION

The invention relates to a swimming goggles assembly, in particular to foldable swimming goggles.

With the development of society, people's life has been greatly improved. More and more people pay attention to outdoor sports, and especially underwater sports are favored by people. Swimming goggles are equipment used in underwater sports. As the goggle frame of common swimming goggles is one-piece and cannot be folded, the common swimming goggles occupy a large space during packaging and transportation, the transportation cost of the product is affected, and thus the sales prices of the swimming goggles rise, which is not conducive to effective application and popularization of the product.

BRIEF SUMMARY OF THE INVENTION

Based on this, the invention aims to provide foldable swimming goggles simple in structure and convenient to transport.

To solve the technical problems, the foldable swimming goggles are provided and include a goggle frame. The goggle frame comprises a left frame body and a right frame body which are connected mutually, the left frame body is provided with a left lens frame, one side of the left lens frame is provided with a supporting block and a limiting block, the supporting block is internally provided with an accommodating groove, the bottom of the accommodating groove of the supporting block is provided with a through hole, and the accommodating groove is internally provided with a spring part; the limiting block is arranged below the supporting block and internally provided with a limiting groove; a pressing shaft is clamped in the accommodating groove and passes through the through hole, the spring part sleeves the outer side of the pressing shaft, and the lower portion of the pressing shaft is fixedly provided with a positioning rotary wheel; the lower end of the positioning rotary wheel is clamped in the limiting groove, and the upper end of the positioning rotary wheel protrudes out of the limiting groove; the right frame body is provided with a right lens frame, one side of the right lens frame is provided with a steering block that is arranged between the supporting block and the limiting block, the steering block is provided with a via hole, the portion, below the via hole, of the steering block is provided with a second toothed groove, and the upper end of the positioning rotary wheel is clamped in the second toothed groove.

In one embodiment, the foldable swimming goggles further comprise a mask, and the mask fits one side of the goggle frame fixedly.

In one embodiment, the mask includes a soft rubber part that fits the human face and a breathing part that fits the human nose, and the soft rubber part is fitted on the outer edges of the left frame body and the right frame body.

In one embodiment, the pressing shaft is provided with a cap and a connection column connected with the cap, one end of the connection column is fixed in a positioning groove, and the spring part sleeves the outer side of the connection column.

In one embodiment, the cap is provided with the positioning groove, and the spring part is clamped in the positioning groove.

In one embodiment, limiting clamp blocks are arranged in the limiting groove at intervals in a protruding manner, limiting clamp grooves are formed between the limiting clamp blocks, the positioning rotary wheel is fixedly arranged below the connection column and comprises a positioning gear and a limiting gear which are coaxially arranged, the positioning gear is arranged above the limiting gear, the connection column is fixedly connected with the positioning gear, and the positioning gear protrudes and stretches out of the limiting groove; the limiting gear is clamped in one of the limiting clamp grooves, and the positioning gear is clamped in the second toothed groove.

In one embodiment, the positioning rotary wheel is fixedly locked on the lower portion of the connection column through a bolt, the positioning rotary wheel is provided with a fixing groove, the bolt is fixed in the fixing groove and extends into the connection column, the lower end of the connection column is fixedly provided with a fixing column, and the positioning rotary wheel is fixed on the lower portion of the fixing column through the bolt.

In one embodiment, clamping teeth are arranged on the fixing column, the lower portion of the connection column is provided with a clamping groove, a first toothed groove is formed in the clamping groove, the fixing column is fixed in the clamping groove, and the clamping teeth are matched with the first toothed groove.

In one embodiment, a first connection plate is arranged on one side of the supporting block of the left lens frame in a protruding manner, a second connection plate is arranged on one side of the steering block of the right lens frame in a protruding manner, and the first connection plate and the second connection plate are matched and connected.

In one embodiment, the bottom of the limiting groove of the limiting block is provided with a sealing cover.

To sum up, according to the foldable swimming goggles, the goggle frame comprises the left frame body and the right frame body, the supporting block and the limiting block are cooperatively arranged on the left frame body, the steering block is arranged on the right frame body, and the left frame body and the right frame body are firmly connected through the pressing shaft and the positioning rotary wheel; when the face fitting angle of the mask needs to be adjusted, the right frame body is slightly adjusted to a suitable angle by pressing the pressing shaft downwards, so that the mask forms a suitable face fitting angle under joint extrusion of the left frame body and the right frame body and can fit the human face better. When the swimming goggles need to be folded, the pressing shaft is pressed downwards to make the positioning rotary wheel separate from the steering block, and thus the right frame body rotates to make the product folded. The structure is simple, the space occupied by the product during transportation is effectively reduced, and the transportation cost of the product is greatly reduced.

DETAILED DESCRIPTION OF THE INVENTION

In order to further understand the features, technical means, specific purposes and functions of the invention, a further detailed description of the invention is given below in combination with the attached drawings and specific embodiments.

Figure 1:
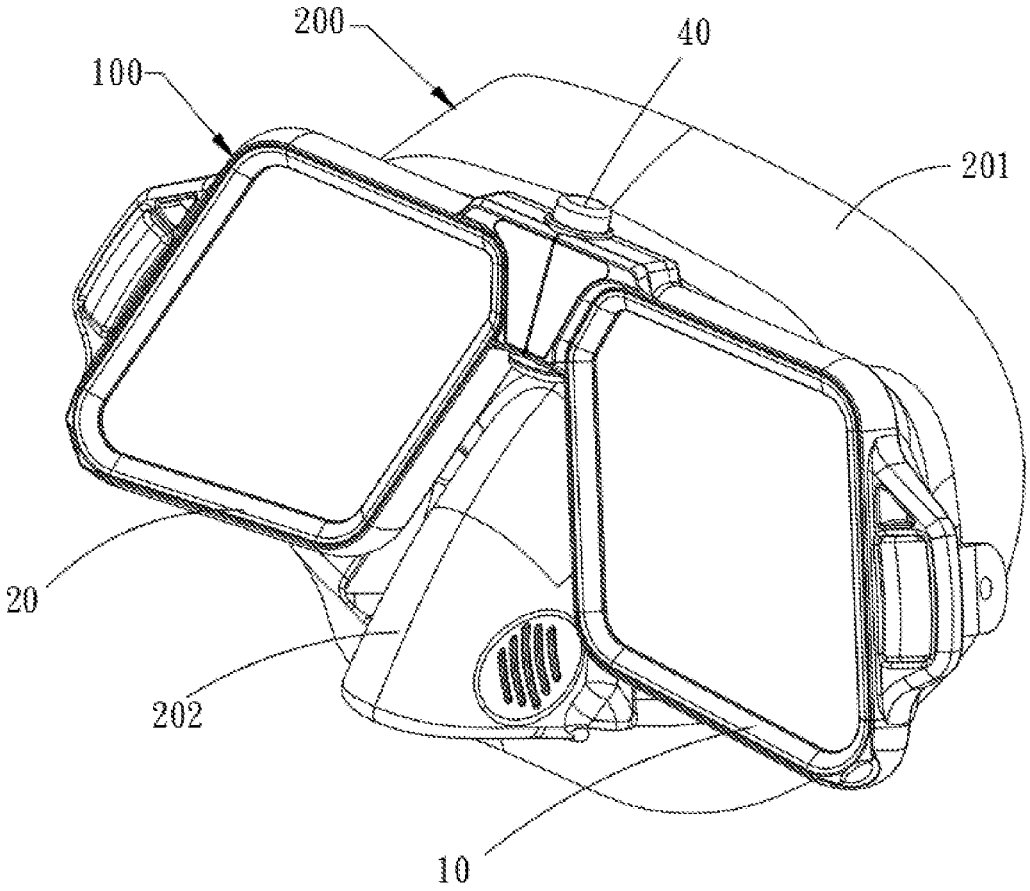
FIG. 1 is a schematic view of foldable swimming goggles.
Figure 2:
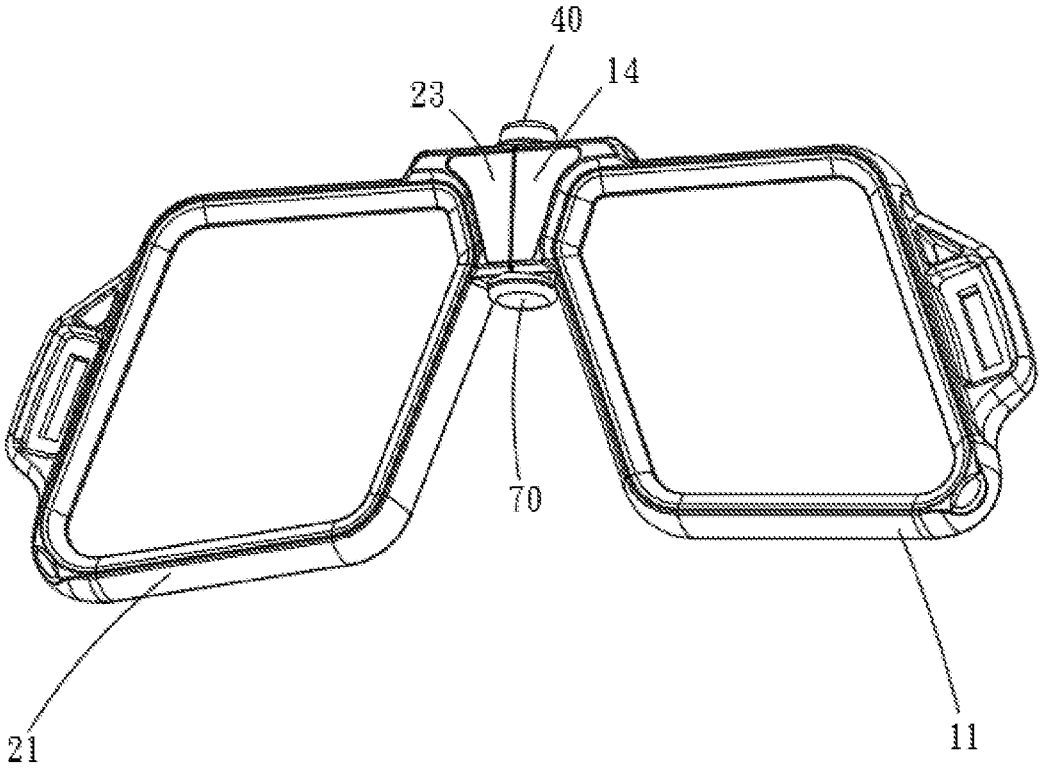
FIG. 2 is a schematic view of the foldable swimming goggles with a mask hidden.
Figure 3:
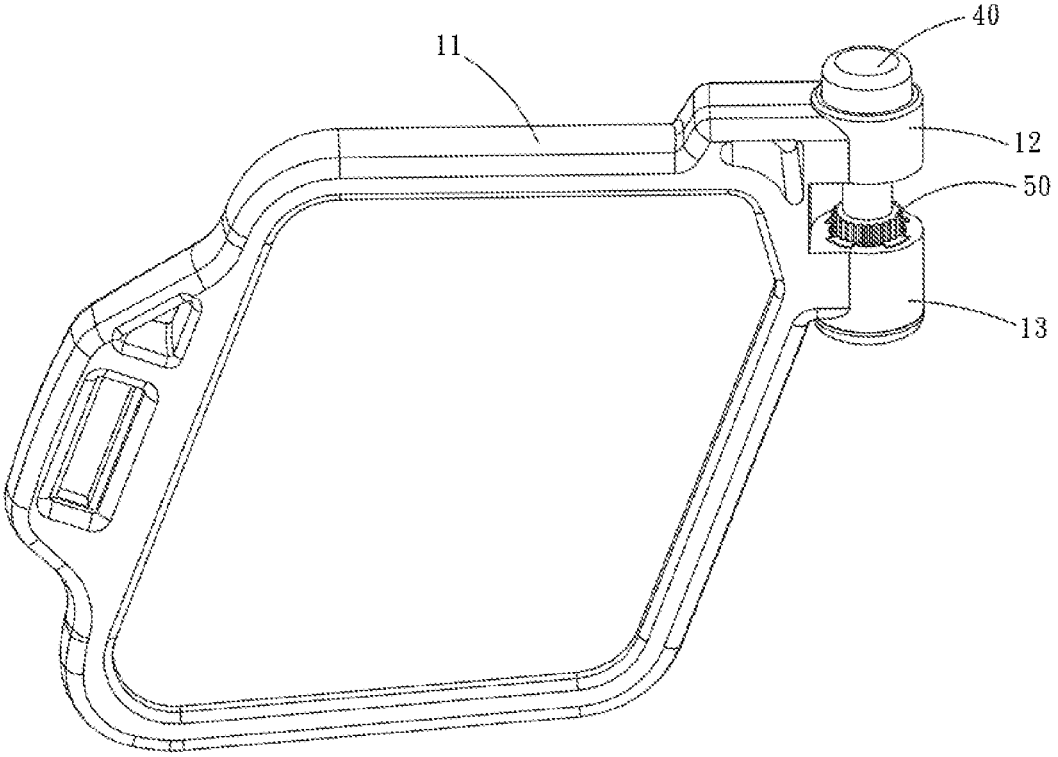
FIG. 3 is a schematic view of the foldable swimming goggles with the mask and a right frame body hidden.
Figure 4:
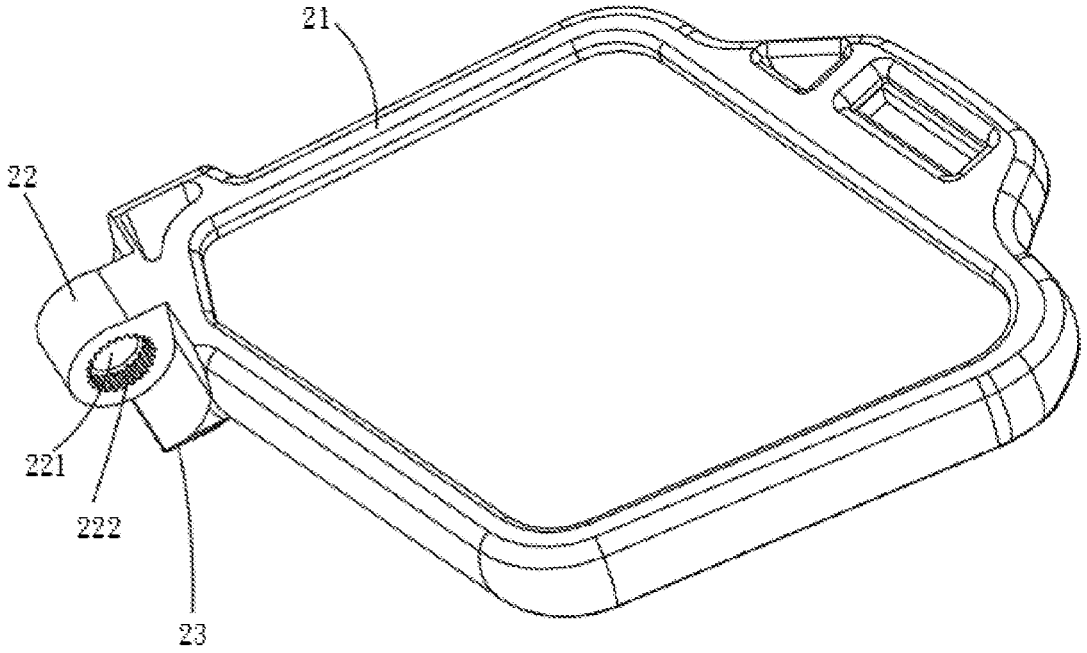
FIG. 4 is a schematic view of the right frame body.
Figure 5:
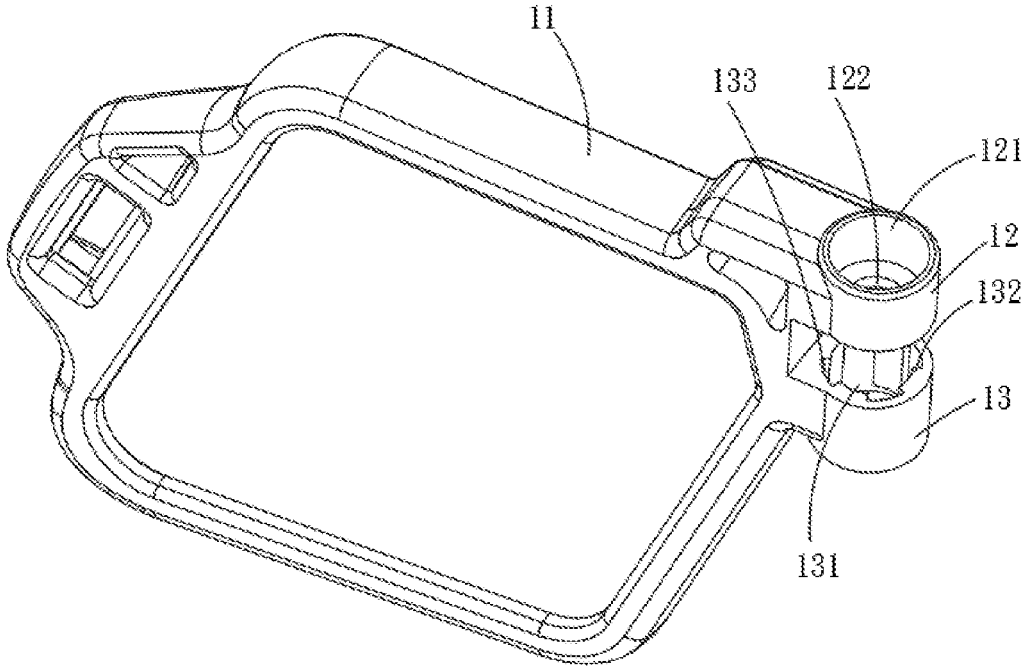
FIG. 5 is a schematic view of a left frame body.
Figure 6:
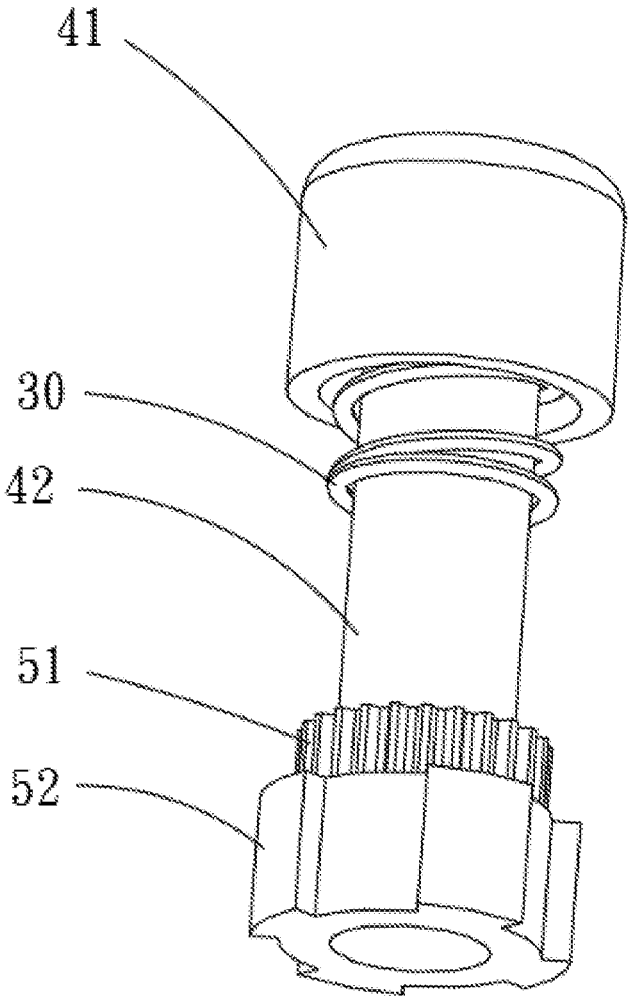
FIG. 6 is a combined schematic view of a pressing shaft, a spring part, a positioning rotary wheel and a bolt.
Figure 7:
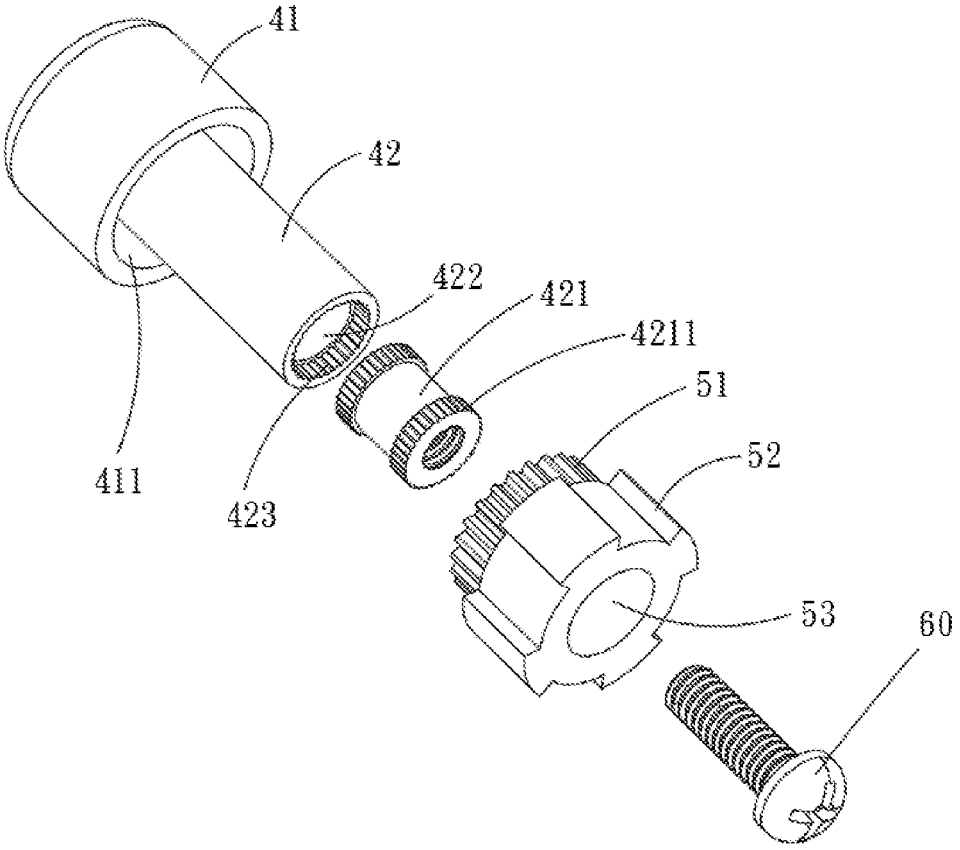
FIG. 7 is an exploded schematic view of the pressing shaft, the spring part, the positioning wheel and the bolt.

As shown in FIG. 1 to FIG. 7, the foldable swimming goggles of the invention comprise a goggle frame 100 and a mask 200, the mask 200 is fixedly arranged on one side of the goggle frame 100, specifically, the goggle frame 100 comprises a left frame body 10 and a right frame body 20 which are mutually connected, the mask 200 comprises a soft rubber part 201 that fits the human face and a breathing part 202 that fits the human nose, and the soft rubber part 201 is fitted on the outer side edges of the left frame body 10 and the right frame body 20 to prevent outside water from entering the soft rubber part 201, and the breathing part 202 is arranged between the left frame body 10 and the right frame body 20.

The left frame body 10 is provided with a left lens frame 11, the upper end of one side of the left lens frame 11 is provided with a supporting block 12 and a limiting block 13 that are spaced, the supporting block 12 and the limiting block 13 are hollow cylinders respectively and coaxially arranged, the supporting block 12 is internally provided with an accommodating groove 121, the bottom of the accommodating groove 121 of the supporting block 12 is provided with a through hole 122, the diameter of the section of the through hole 122 is smaller than that of the accommodating groove 121, and the accommodating groove 121 is internally provided with a spring part 30; the limiting block 13 is arranged below the supporting block 12, the supporting block 13 is internally provided with a limiting groove 131, limiting clamp blocks 132 are arranged in the limiting groove 131 of the limiting block 13 at intervals in a protruding manner, and limiting clamp grooves 133 are formed between the limiting clamp blocks 132.

A pressing shaft 40 is clamped in the accommodating groove 121, the lower end of the pressing shaft 40 passes through the through hole 122 and extends to a position below the supporting block 12, and the spring part 30 sleeves the outer side of the pressing shaft 40 to provide acting force for the pressing shaft 40 so that the pressing shaft 40 can return to its initial position; the pressing shaft 40 is provided with a cap 41 and a connection column 42 connected with the cap 41, the cap 41 is provided with a positioning groove 411, one end of the connection column 42 is fixed in the positioning groove 411, and the spring part 30 sleeves the outer side of the connection column 42 and is clamped in the positioning groove 411.

The lower portion of the pressing shaft 40 is fixedly provided with a positioning rotary wheel 50, the lower end of the positioning rotary wheel 50 is clamped in the limiting groove 131, the upper end of the positioning rotary wheel 50 protrudes and stretches out of the limiting groove 131, and specifically, the positioning rotary wheel 50 is fixedly arranged on the lower portion of the connection column 42. The positioning rotary wheel 50 comprises a positioning gear 51 and a limiting gear 52 which are arranged coaxially, the positioning gear 51 is arranged above the limiting gear 52, the connection column 42 is fixedly connected with the positioning gear 51, and the positioning gear 51 protrudes and stretches out of the limiting groove 131; the limiting gear 52 is clamped in one of the limiting clamp grooves 133 so that the positioning rotary wheel 50 cannot rotate under the limiting effect of the limiting clamp grooves 133, and the assembly stability of the product is effectively improved.

In one embodiment, the positioning rotary wheel 50 is locked on the lower portion of the connection column 42 fixedly through a bolt 60 specifically, the positioning rotary wheel 50 is provided with a fixing groove 53, the bolt 60 is fixed in the fixing groove 53 and extends into the connection column 42, the lower end of the connection column 42 is fixedly provided with a fixing column 421, the positioning rotary wheel 50 is fixed on the lower portion of the fixing column 421 through the bolt 60, clamping teeth 4211 are arranged on the fixing column 421, the lower portion of the connection column is provided with a clamping groove 422, the clamping groove 422 of the connection column 42 is internally provided with a first toothed groove 423, the fixing column 421 is fixed in the clamping groove 422, the clamping teeth 4211 are matched with the first toothed groove 423, and thus the positioning rotary wheel 50 is firmly fixed on the lower portion of the connection column 42.

The right frame body 20 is provided with a right lens frame 21, one side of the right lens frame 21 is provided with a steering block 22, the steering block 22 is arranged between the supporting block 12 and the limiting block 13 and provided with a via hole 221, the portion, below the via hole 221, of the steering block 22 is provided with a second toothed groove 222, the connection column 42 is arranged in the via hole 221, the upper end of the positioning rotary wheel 50 is clamped in the second toothed groove 222, and specifically, the positioning gear 51 is clamped in the second toothed groove 222 so as to limit the steering block 22 and ensure that the right lens frame 21 will not rotate with the left lens frame 11.

During specific assembly of the swimming goggles, the positioning rotary wheel 50 is placed in the limiting groove 131 of the limiting block 13, the left frame body 10 and the right frame body 20 are connected, at this time, the steering block 22 is placed between the supporting block 12 and the limiting block 13, then the pressing shaft 40 sleeved with the spring part 30 successively passes through the through hole 122 and the via hole 221, and the positioning rotary wheel 50 and the pressing shaft 40 are fixedly connected through the bolt 60 to complete the assembly of the goggle frame 100. Finally, the mask 200 fits the outer edges of the left frame body 10 and the right frame body 20 respectively to complete the assembly process of the product. When the assembled product needs to be transported, the left frame body 10 and the right frame body 20 can be rotated to come close to each other and then be folded based on the flexibility of the mask 200, so that the space occupied by the product during transportation is effectively reduced and the transportation cost of the product is greatly reduced.

To be specific, the pressing shaft 40 is pressed downwards to drive the positioning rotary wheel 50 to move downwards, so that the positioning gear 51 is separated from the second toothed groove 222 of the steering block 22. Without the positioning function of the positioning gear 51, the steering block 22 can turn over with the pressing shaft 40 as an axis, so that the right frame body 20 is turned towards one side of the left frame body 10 to complete folding operation of the left frame body 10 and the right frame body 20. After the right frame body 20 is turned over, the pressing shaft 40 is released and resets upward under the restoring force of the spring part 30. At this time, the positioning gear 51 is clamped in the second toothed groove 222 again to complete positioning of the left frame body 10 and the right frame body 20. When it is necessary to use the product, the operation is repeated, the pressing shaft 40 is pressed down, the right frame body 20 rotates and returns back to its original position, and then the pressing shaft 40 is released to complete the positioning of the left frame body 10 and the right frame body 20; at the same time, the face fitting angle of the mask 200 can be adjusted by rotating the right frame body 20. When it is necessary to adjust the face fitting angle of the mask 200, the pressing shaft 40 is pressed down, and the right frame body 20 is slightly adjusted to a suitable angle, so that the mask 200 forms a suitable face fitting angle under the joint extrusion of the left frame body 10 and the right frame body 20 and thus fits the face better.

In one embodiment, a first connection plate 14 is arranged on one side of the supporting block 12 of the left lens frame 11 in a protruding manner, a second connection plate 23 is arranged on one side of the steering block 22 of the right lens frame 21 in a protruding manner, the first connection plate 14 is matched and connected with the second connection plate 23 to limit the turning angle of the right frame body 20 to avoid the excessive rotation of the right frame body 20, which may otherwise affect the use effect of the product.

In one embodiment, the bottom of the limiting groove 131 of the limiting block 13 is provided with a sealing cover 70 to improve the attraction of the product.

To sum up, according to the foldable swimming goggles, the goggle frame 100 comprises the left frame body 10 and the right frame body 20, the supporting block 12 and the limiting block 13 are cooperatively arranged on the left frame body 10, the steering block 22 is arranged on the right frame body 20, and firm connection of the left frame body 10 and the right frame body 20 is completed through combination of the pressing shaft 40 and the positioning rotary wheel 50; when the face fitting angle of the mask 200 needs to be adjusted, the right frame body 20 is slightly adjusted to a suitable angle by pressing the pressing shaft 40 downwards, so that the mask 200 forms a suitable face fitting angle under joint extrusion of the left frame body 10 and the right frame body 20 and can fit the human face better. When the swimming goggles need to be folded, the pressing shaft 40 is pressed downwards to make the positioning rotary wheel 50 separate from the steering block 22, and thus the right frame body 20 rotates to make the product folded. The structure is simple, the space occupied by the product during transportation is effectively reduced, and the transportation cost of the product is greatly reduced.

The embodiments described in the invention in rather full detail are considered as illustrative, and not restrictive, of the scope of the invention. It should be understood that modifications and variations can be made by those skilled in the art without departing from the design of the invention, and such modifications and variations all fall in the protection extent of the invention. Therefore, the protection extent of the invention is based on the appended claims.

What is claimed is:

1. Foldable swimming goggles, including a goggle frame, wherein the goggle frame comprises a left frame body and a right frame body which are connected mutually, the left frame body is provided with a left lens frame, one side of the left lens frame is provided with a supporting block and a limiting block, the supporting block is internally provided with an accommodating groove, a bottom of the accommodating groove of the supporting block is provided with a through hole, and the accommodating groove is internally provided with a spring part; the limiting block is arranged below the supporting block and internally provided with a limiting groove; a pressing shaft is clamped in the accommodating groove and passes through the through hole, the spring part sleeves an outer side of the pressing shaft, and a lower portion of the pressing shaft is fixedly provided with a positioning rotary wheel; a lower end of the positioning rotary wheel is clamped in the limiting groove, and an upper end of the positioning rotary wheel protrudes out of the limiting groove; the right frame body is provided with a right lens frame, one side of the right lens frame is provided with a steering block that is arranged between the supporting block and the limiting block, the steering block is provided with a via hole, a portion, below the via hole, of the steering block is provided with a second toothed groove, and the upper end of the positioning rotary wheel is clamped in the second toothed groove.

2. The foldable swimming goggles according to claim 1, wherein the swimming goggles further comprise a mask, and the mask fits one side of the goggle frame fixedly.

3. The foldable swimming goggles according to claim 2, wherein the mask includes a soft rubber part that is configured to fit a human face and a breathing part that is configured to fit a human nose, and the soft rubber part is fitted on outer side edges of the left frame body and the right frame body.

4. The foldable swimming goggles according to claim 1, wherein the pressing shaft is provided with a cap and a connection column connected with the cap, one end of the connection column is fixed in a positioning groove, and the spring part sleeves an outer side of the connection column.

5. The foldable swimming goggles according to claim 4, wherein the cap is provided with the positioning groove, and the spring part is clamped in the positioning groove.

6. The foldable swimming goggles according to claim 4, wherein limiting clamp blocks are arranged in the limiting groove at intervals in a protruding manner, limiting clamp grooves are formed between the limiting clamp blocks, the positioning rotary wheel is fixedly arranged below the connection column and comprises a positioning gear and a limiting gear which are coaxially arranged, the positioning gear is arranged above the limiting gear, the connection column is fixedly connected with the positioning gear, and the positioning gear protrudes and stretches out of the limiting groove; the limiting gear is clamped in one of the limiting clamp grooves, and the positioning gear is clamped in the second toothed groove.

7. The foldable swimming goggles according to claim 4, wherein the positioning rotary wheel is fixedly locked on a lower portion of the connection column through a bolt, the positioning rotary wheel is provided with a fixing groove, the bolt is fixed in the fixing groove and extends into the connection column, a lower end of the connection column is fixedly provided with a fixing column, and the positioning rotary wheel is fixed on a lower portion of the fixing column through the bolt.

8. The foldable swimming goggles according to claim 7, wherein clamping teeth are arranged on the fixing column, the lower portion of the connection column is provided with a clamping groove, a first toothed groove is formed in the clamping groove, the fixing column is fixed in the clamping groove, and the clamping teeth are matched with the first toothed groove.

9. The foldable swimming goggles according to claim 1, wherein a first connection plate is arranged on one side of the supporting block of the left lens frame in a protruding manner, a second connection plate is arranged on one side of the steering block of the right lens frame in a protruding manner, and the first connection plate and the second connection plate are matched and connected.

10. The foldable swimming goggles according to claim 1, wherein a bottom of the limiting groove of the limiting block is provided with a sealing cover.

* * * * *